US005150912A

United States Patent [19]

Lucas et al.

[11] Patent Number: 5,150,912

[45] Date of Patent: Sep. 29, 1992

[54] SKI BRAKE

[75] Inventors: Christian Lucas, Nevers; Roland Bardin, V. Vauzelles, both of France

[73] Assignee: Look S.A., Nevers cedex, France

[21] Appl. No.: 736,856

[22] Filed: Jul. 29, 1991

[30] Foreign Application Priority Data

Aug. 31, 1990 [DE] Fed. Rep. of Germany ..... 4027712

[51] Int. Cl.[5] ..... A63C 7/10

[52] U.S. Cl. ..... 280/605

[58] Field of Search ..... 280/605

[56] References Cited

U.S. PATENT DOCUMENTS 4,108,466 8/1978 Weigl et al. ..... 280/605
4,171,138 10/1979 Riedel ..... 280/605
4,239,256 12/1980 Krob et al. ..... 280/605

FOREIGN PATENT DOCUMENTS 2554110 3/1988 Fed. Rep. of Germany .
669735 4/1989 Switzerland .

*Primary Examiner*—Eric D. Culbreth
*Attorney, Agent, or Firm*—Townsend & Townsend

[57] ABSTRACT

In a ski brake with brake arms (12) and actuating arms (14) a pedal (16) is mounted to the actuating arms (14) about a second transverse axis (15). A linkage arrangement (17) is provided approximately parallel to the actuating arms (14) and is pivotally connected to the pedal (16) about a third transverse axis (18) and to the ski about a fourth transverse axis (19). The fact that the spacing of the second transverse axis (15) from the third transverse axis (18) is somewhat smaller than the spacing between the first transverse axis (13) and the fourth transverse axis (19) means that the pedal (16) can execute a small counter-pivotal movement on transfer of the ski brake from the braking position into the rest position.

12 Claims, 3 Drawing Sheets

SKI BRAKE

DESCRIPTION

Figure 1:
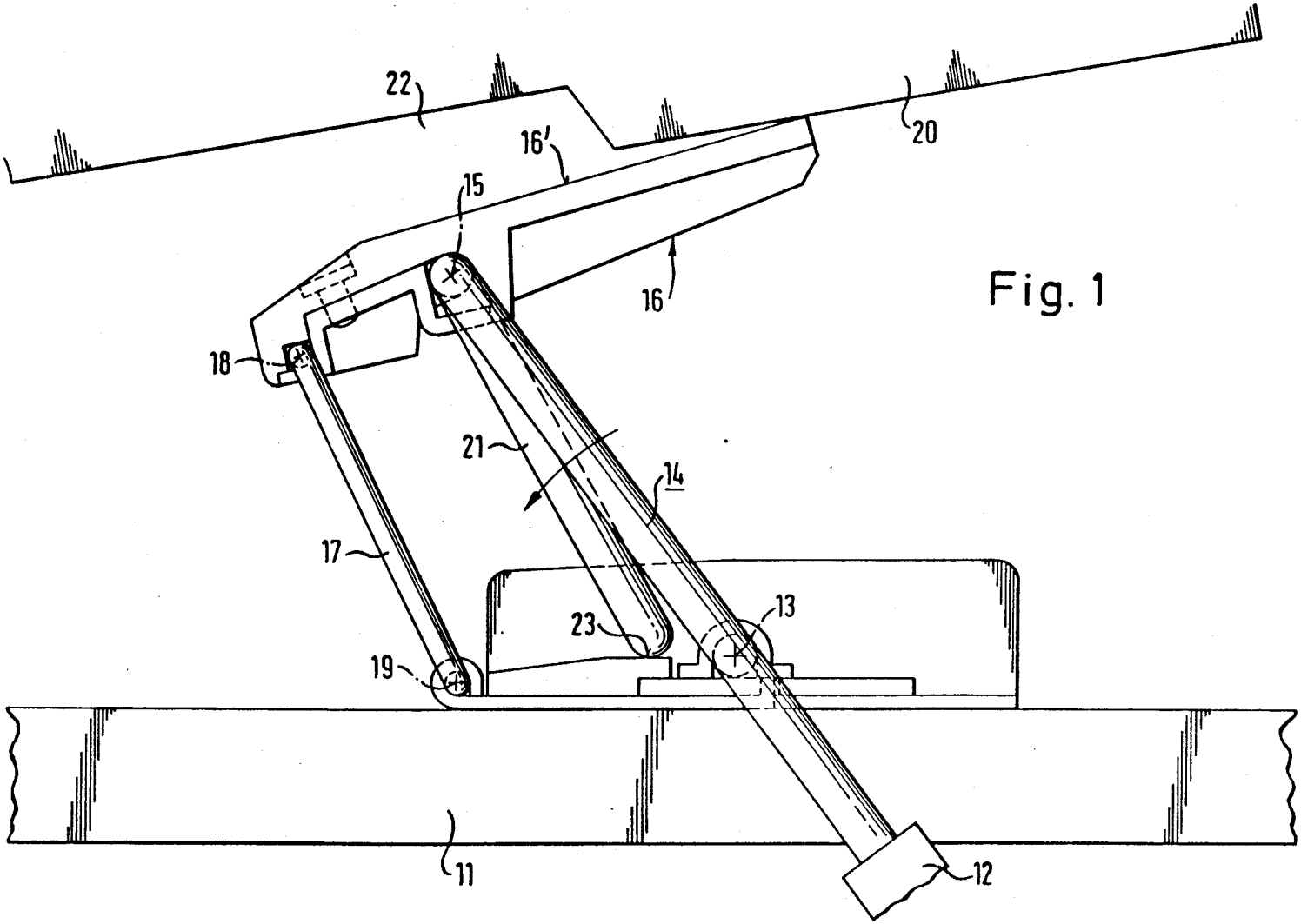

The invention relates to a ski brake for a ski released from a ski boot, the ski brake comprising brake arms which extend to the side of the ski at least in the braking position and which are pivotable against a spring deployment force about a transverse axis between the braking position, in which they extend downwardly from the running surface of the ski, and a rest position, in which they lie above the ski running surface essentially parallel to the longitudinal direction of the ski.

In a ski brake of this kind (as known from Swiss patent 669 735) the brake arms are rotationally fixedly connected at the opposite side of the transverse axis from their braking ends to an actuating arm arrangement which is arranged above the ski and is pivotally connected at its end remote from the transverse axis to a pedal about a second transverse axis. The pedal is kept essentially parallel to the ski in all positions of the use by a linkage arrangement which extends essentially parallel to the actuating arm. The linkage arrangement is pivotally connected to the pedal at a distance in the longitudinal direction of the ski from the second transverse axis about a third transverse axis. Moreover, it is pivotally mounted to the ski or to a part connected therewith at a distance in the same direction from the first transverse axis about a fourth transverse axis.

In the known ski brake of this kind (CH-PS 669 735) the sole of the ski boot acts on the pedal in its front region which is in particular disadvantageous when the pedal engages into the recess of the sole of the ski boot which is generally provided in front of heel of the ski boot. On pressing the pedal downwardly the ski boots executes, in addition to movement toward the ski, a movement forwardly as well. The pedal, however, remains in the recess of the boot in the rest position of the ski brake so that only an incomplete transfer of the ski brake into its rest position is achieved.

The object of the invention is thus to provide a ski brake of the initially named kind in which, in the rest position, a full and reliable transfer into the completely debraked position is ensured.

In order to satisfy this object the present invention provides that the spacing of the second and third transverse axes is smaller than the spacing of the first and fourth transverse axes, and that the spacing of the third and fourth transverse axes is essentially correspondingly smaller than the spacing of the first and second transverse axes, in such a way that the pedal, on being pivoted out of the braking position into the rest position is pivoted in the opposite direction to the direction of pivoting of the actuating arm relative to the ski. The pedal preferably extends rearwardly into the region of the heel of the boot and is acted on in each position only by the heel of the ski boot. It is of particular advantage for the boot heel to engage, other than in the debraked rest position, essentially only with the rear edge or the rearmost region of the pedal.

As a result of the construction in accordance with the invention the pedal can be so tilted in the braking position against the direction of pivoting of the actuating arm arrangement that the rear region of the pedal adopts the highest position above the ski surface, whereby the heel of the ski boot, on insertion of the ski boot into the ski binding cooperating with the ski brake, first comes into contact with the rear region or indeed the rear end of the pedal which is located at a clear spacing from the aforementioned recess in the region of the lower surface of the heel of the ski boot. On pressing the pedal downwardly the pedal executes a pivotal movement opposite to the pivotal direction of the ski brake so that it becomes flatter prior to reaching the rest position. Contact with the heel of the ski boot is however maintained so that on attaining the rest position complete debraking takes place, i.e. the brake arms are reliably located above the surface of the ski.

It is thus an important concept that the pedal which lies flat on the surface of the ski in the rest position is tilted in the deployed braking position in such a way that its rear end has a greater spacing from the ski surface than its front region. As the pedal, on being pressed downwardly, also executes a pivotal movement, in addition to coming closer to the ski, the press down force exerted by the heel of the ski boot on the pedal is somewhat smaller than the spring force which counteracts the downward pivotal movement of the actuating arm arrangement.

In accordance with the invention, the downward treading of the pedal thus results in a movement of the latter essentially parallel to the ski, however with a small pivotal movement contrary to that of the actuating arm arrangement being superimposed on this movement. The ski boot is thus also better guided during insertion into the binding.

The braking arms and the actuating arm arrangement and also the deployment spring can be constructed in known manner, for example in accordance with German patent specification 25 54 110. The linkage arms are expediently displaced in the sidewise direction relative to the actuating arm arrangement so that the linkage arms and the actuating arms do not hinder one another during their movement.

Figure 2:
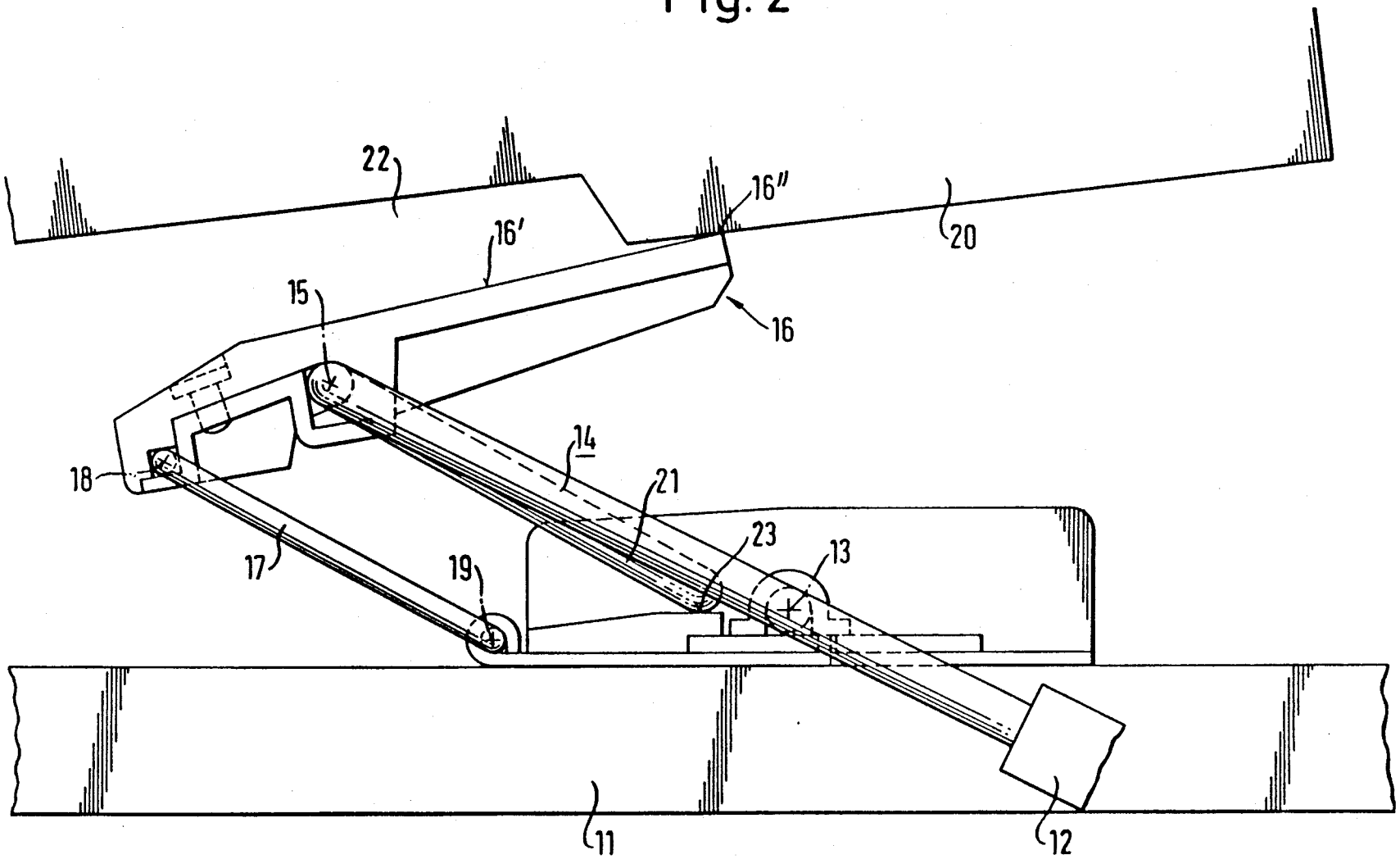
Figure 3:
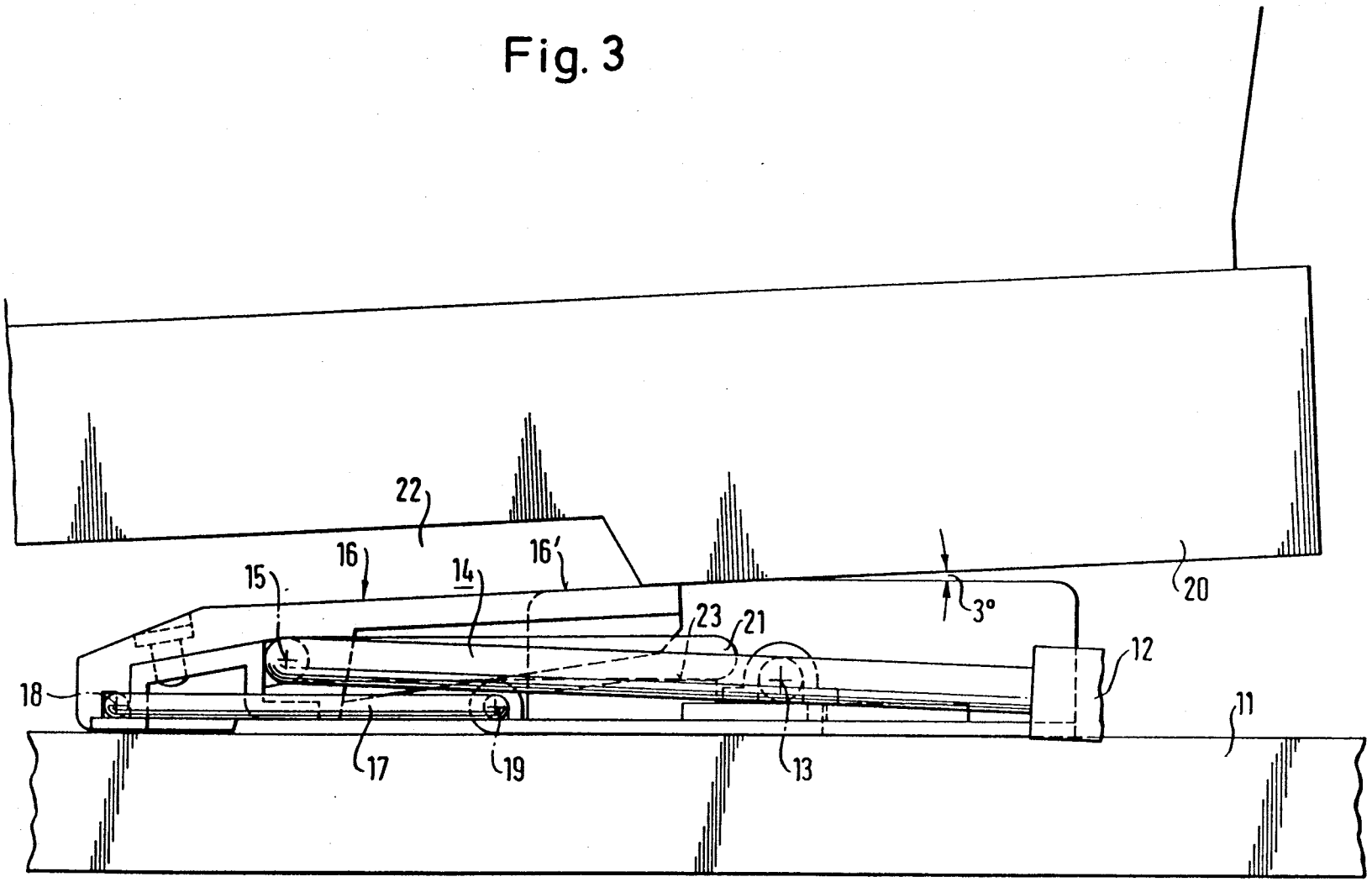

The invention will now be described in the following by way of example only and with reference to the drawing in which are shown:

FIG. 1—a schematic sideview of a ski brake in accordance with the invention in the braking position, with an inserted ski boot being schematically illustrated, FIG. 2—a corresponding view of the same ski brake in an intermediate position, and FIG. 3—a corresponding sideview of the same ski brake in the debraked rest position.

In accordance with FIG. 1 the actuating arm arrangement 14 of the ski brake is pivotally mounted about a transverse axis 13 on the ski 11 directly in front of a non-illustrated heel binding which is secured to the ski 11. The brake arms 12 extend from the pivot axle 13 on both sides of the ski 11 into a position substantially below the running surface of the ski 11. I.e. the braking types or ends of the brake arms are located beneath the running surface of the ski in the deployed braking position. The actuating arm arrangement 14 is preferably a wire hoop such as is shown in DE-PS 25 54 110. A spring element 21 extends from the end of the actuating arrangement 14 remote from the transverse axis 13 to the surface of the ski 11 against which it is braced at 23. The spring element is, in the manner which can be seen from FIG. 1 bent somewhat out of the plan of the actuating arm arrangement 14 downwardly so that on pivotal movement of the actuating arm arrangement 14 in the direction of the arrow the spring element 21 is pressed into the plane of the actuating arm arrangement 14. In this way a return or deployment spring force is generated which attempts to pivot the actuating arm arrangement 14 into the braking position which can be seen in FIG. 1.

A pedal 16 is pivotally mounted about a second transverse axis 15 to the end of the actuating arm arrangement 14 remote from the transverse axis 13 At a distance in front of the second transverse axis 15 a third transverse axis 18 is provided on the pedal to which a linkage arrangement 17 is pivotally connected. The linkage arrangement 17 is pivotally secured to the ski 11 about a fourth transverse axis 19 at a distance in front of the first transverse axis 13. The linkage arrangement 17 can comprise two individual links which are arrangement parallel to one another and spaced apart in the transverse direction. It could also comprise a U shaped or N shaped piece of stiff wire with the free ends of the limbs bent outwardly or inwardly to form either the transverse axis 18 or the transverse axis 19 respectively. The centre portion of the U or N shaped wire would then form the other axis 19 or 18 respectively. The centre portion of the U or N shaped wire would then form the other axis 19 or 18 respectively. In the corresponding manner the actuating arm arrangement 14 can comprise two parallel laterally spaced bars or wires which are connected at the top by a transverse element from which the bar or hoop-like spring element 21 starts.

In accordance with the invention the spacing of the second transverse axis 15 and the third transverse axis 18 is somewhat smaller than the spacing of the first transverse axis 13 and the fourth transverse axis 19. The spacing of the second and third transverse axes (15, 18) is 10 to 50%, preferably 20 to 40% and particularly approximately 30% smaller than the spacing of the first and fourth transverse axes (13, 19). To enable the transverse axes 13, 15, 18, 19 to be aligned with one another essentially in the longitudinal direction of the ski in the rest position of the brake (FIG. 3) the spacing of the third transverse axis 18 from the fourth transverse axis 19 should accordingly be somewhat smaller than the spacing of the second transverse axis 15 from the first transverse axis 13.

Furthermore, the pedal, which preferably has an essentially flat surface 16' should extend in the braking position which can be seen from FIG. 1 somewhat obliquely rearwardly and should rise upwardly. Moreover, it should extend so far rearwardly that on inserting a ski boot into the non-illustrating binding the heel 20 of the si boot comes into the engagement with the rear end of the pedal 16. In the braking position, the preferably flat surface (16') of the pedal (16) which drops away from the rear towards the front has an inclination relative to the ski surface of 5 to 25°, preferably 10 to 2020 , and in particular approximately 15°. In this way it is possible to prevent the pedal 16 entering into the recess 22 which is generally provided in the ball region in front of the heel 20 of the ski boot and which could hinder the insertion of the ski boot into the binding and could also lead to the ski boot not being fully transferred into the debraked position on pressing the pedal 16 downwardly.

The above-mentioned difference in spacing between the transverse axes 15, 18, on the one hand, and 13, 19 on the other hand is to be dimensioned such that the pedal 16, starting from the somewhat rearwardly inclined position of FIG. 1, completes a pivotal movement in the clockwise sense on being pressed downwardly so that it finally comes to lie at least substantially parallel to the surface of the ski in the debraked rest position of FIG. 3. The pedal executes an angular movement between the braking position and the position of use of 5 to 25°, preferably 10 to 20° and in particular approximately 15°. Whereas the angle of the flat surface of the pedal 16 amounts to approximately 16° in the braking position of FIG. 1 it is reduced in the intermediate position of FIG. 2 to approximately 13° and in the rest position of FIG. 3 to an angle of zero to 5°, in particular 2 to 3°, with respect to the ski surface.

As shown in FIG. 1, this construction also leads to the heel 20 of the ski boot engaging the pedal 16 at its rearmost end in i.e., at the maximum spacing from the transverse axes 15 and 18, which is particularly favourable from a force viewpoint. The heel 20 lies practically flat on the surface of the pedal 16 only in the rest position of FIG. 3, and indeed essentially only in its rear region.

The operation of the ski brake of the invention is as follows:

If, in the braking position of FIG. 1, the ski boot is placed in the manner illustrated there onto the pedal 16, and if a force is then exerted downwardly onto the pedal 16, then the actuating arm arrangement 14 and the linkage arrangement 17 are pivoted with compression of the spring element 21 in the counterclockwise sense while, on the other hand, the pedal 16 is pivoted fractionally in the opposite sense, i.e. in the clockwise sense relative to the ski 11. An intermediate position is shown in FIG. 2.

In the rest position of FIG. 3 the pedal 16 adopts a position which extends parallel to the surface of the sole of the ski boot, so that the pedal only projects minimally above the surface the of the ski 11 and thus does not hinder the arrangement of the ski boot within the non-illustrated binding of the ski.

If the ski boot is moved out of the ski binding, for example in the case of a fall, then the spring element 21 again deploys the actuating arm arrangement 14 with the linkage arrangement 17 and also the braking arms 12 and the pedal 16 into the braking position, which can be seen from FIG. 1.

We claim:

1. Ski brake for preventing runaway of a ski (11) released from a ski boot, the ski brake comprising brake arms (12) which are pivotable against a spring deployment force about a transverse axis (13) between a braking position, in which they extend downwardly from the running surface of the ski, and a rest position, in which they lie above the ski running surface essentially parallel to the longitudinal direction of the ski, wherein the brake arms extend to the side of the ski in at least the braking position and are rotationally fixedly connected at the opposite side of the transverse axis (13) from their braking ends (12) to an actuating arm arrangement (14) which is arranged above the ski (11) and is pivotally connected at an end remote from the transverse axis to a pedal (16) about a second transverse axis (15) with the pedal being kept essentially parallel to the ski (11) in all positions of use by a linkage arrangement (17) which extends essentially parallel to the actuating arm (14) and which is pivotally connected to the pedal (16) at a distance in the longitudinal direction of the ski from the second transverse axis (15) about a third transverse axis (18) and is pivotally mounted at a point fixed with respect to the ski (11) at a distance in the same direction from the first transverse axis (13) about a fourth transverse axis (19), characterized in that the distance between the second and third transverse axes (15, 18) is smaller than the distance between the first and fourth transverse axes (13, 19) and the distance between the third and fourth transverse axes (18, 19) is essentially correspondingly smaller than the distance between the first and second transverse axes (13, 15) in such a way that the pedal (16) on being pivoted out of the braking position into the rest position is pivoted in the opposite direction to the direction of pivoting of the actuating arm (14) relative to the ski (11).

2. Ski brake in accordance with claim 1, characterized in that the distance between the second and third transverse axes (15, 18) is in the range of 10 to 50% smaller that the distance between the first and fourth transverse axes (13, 19).

3. The ski brake of claim 2 wherein the spacing of the second and third transverse axis (15, 16) is approximately 30% smaller than the spacing of the first and fourth transverse axis (13, 19).

4. Ski brake in accordance with claim 1, characterized in that the pedal (16) executes an angular movement between the braking position and the position of use of from 5 to 25°.

5. The ski brake of claim 4 wherein the pedal (16) executes an angular movement between the braking position and the position of use of approximately 15°.

6. Ski brake in accordance with claim 1, characterized in that the pedal (16) has a surface (16') which, in the braking position, drops away from the rear towards the front at an inclination relative to the ski surface of 5 to 25°.

7. The ski brake of claim 6, where in said surface (16') drops away from the rear toward the front at an inclination relative to the ski surface of approximately 15°.

8. Ski brake in accordance with claim 1, characterized in that the pedal (16) has a surface (16') disposed at an angle of 9 to 5° with the ski surface in the depressed rest position, with the surface (16') dropping off from the rear to the front in so far as the angle is greater than 0°.

9. The ski brake of claim 8 wherein said surface (16') is disposed at an angle of 2 to 3° with the ski surface in the depressed rest position.

10. Ski brake in accordance with claim 1, characterized in that, when a ski boot is being fastened to the ski, the pedal (16) extends rearwardly into the area of the boot heel (20) and is acted on in each position only by the heel (20) of the ski boot.

11. Ski brake in accordance with claim 10, characterized in that, during the fastening of the ski boot to the ski, the boot heel engages, other that in the debraked rest position, only a portion of the pedal (16) proximate to the rear edge (16').

12. Ski brake in accordance with claim 1, characterized in that the linkage arrangement (17) lies in front of the actuating arm arrangement (14.)

* * * * *